US005397963A

United States Patent [19]

Manson

[11] Patent Number: 5,397,963

[45] Date of Patent: Mar. 14, 1995

[54] SUBSYSTEM AND METHOD FOR DETECTING LAMP FAILURE

[75] Inventor: James D. Manson, Orange, Calif.

[73] Assignee: New Bedford Panoramex Corporation, Upland, Calif.

[21] Appl. No.: 116,011

[22] Filed: Sep. 2, 1993

[51] Int. Cl.[6] ..... H01J 1/60

[52] U.S. Cl. ..... 315/129; 315/130; 315/131; 315/132; 315/119; 315/122; 315/121

[58] Field of Search ..... 315/129, 130, 131, 132, 315/119, 122, 121

[56] References Cited

U.S. PATENT DOCUMENTS

| | | | |
|---|---|---|---|
| 4,210,846 | 7/1980 | Capewell et al. | 315/122 |
| 4,977,353 | 12/1990 | Helal et al. | 315/311 |
| 5,105,124 | 4/1992 | Futsuhara et al. | 315/129 |
| 5,168,198 | 12/1992 | Watanabe | 315/131 |

OTHER PUBLICATIONS

Airfield Failed Light Detection/Location System, Teledyne Controls, Jul. 1, 1993.

*Primary Examiner*—Robert J. Pascal
*Assistant Examiner*—Reginald A. Ratliff
*Attorney, Agent, or Firm*—Frank J. Uxa

[57] ABSTRACT

A dual mode high intensity aircraft approach lighting system includes a plurality of lights interconnected by means of power wiring. An improved subsystem for detecting lamp failures is disclosed which permits a positive identification of individual failed lamps at a remote location, such as the control tower of an airport, for instance. The subsystem hardware consists of an operational monitor processor, three lamp controllers, one for each of three lighting loops, one remote lamp transceiver module per lamp, and existing ac loop wiring. The operational monitor processor board initiates a reset of the lamp controller and remotely installed transceiver units by sending a SAMPLE ALL signal to each lamp controller. A comprehensive test of all lamps in each of the three lighting loops is performed. The first lamp controller board sequentially polls each lamp for operational status in the first loop. Upon completion of polling the first lighting loop, the second lamp controller automatically tests the second loop, and subsequently the third. During lamp controller reception of return status data from the remote lamp transponders, the functional status of each lamp is determined. Any instance of a failed lamp will generate a signal to the operational monitor processor.

21 Claims, 8 Drawing Sheets

SUBSYSTEM AND METHOD FOR DETECTING LAMP FAILURE

BACKGROUND OF THE INVENTION

This invention relates to a system for remotely detecting the failure of individual lamps in a multilamp lighting system, and more particularly to a system for detecting the failure of such lamps in a high intensity approach lighting system for an airport.

Many airports today, particularly those having Category II runways under Federal Aviation Administration (FAA) classification criteria, are equipped with a dual mode high intensity approach lighting system. Such a system provides visual approach lighting patterns to landing aircraft, and typically has a first high intensity approach lighting system mode and a second simplified short approach lighting system mode. The typical system is capable of providing 3000 foot patterns with any needed glide slope angle restrictions, and also shorter 2400 foot patterns for use on other domestic Category II runways, and includes both steady burning approach lights and sequenced flashing lights to provide directional guidance to the approaching aircraft. The steady burning approach lights are connected in a number of constant current lighting loops, and may be operated at several, for example, five, distinct brightness levels. Switching between the modes may be locally controlled from an adjacent substation, or remotely controlled from the air traffic control tower via a control subsystem.

In the first high intensity approach mode, the typical system includes approximately 100 lamps of the 300 to 500 watt type, connected in series in each of a plurality, for example, three, constant current loops. Additionally, fifteen flashers are active in a typical embodiment, so that the sequence will begin with the flasher farthest from the threshold of the runway and proceed toward the flasher closest to the runway threshold. Of course, the actual number of lamps and lamp wattage may vary for each loop of steady burning lights, and the number of flashers may vary for a specific application.

In the second simplified short approach mode, approximately 18–25 steady burning 300–500 watt lamps are employed, while approximately every other flasher employed in the first mode is used in the second mode, so that the time interval between flashes of a single sequence in the second mode is about twice that in the first mode.

FIG. 1 is a system block diagram illustrating a typical prior art dual mode approach lighting system 11. The system 11 includes equipment packages in three geographic locations, including a runway equipment package 13, a substation equipment package 15, and a control tower equipment package 17. The runway equipment package 13 includes steady burning lights 19 (preferably of the PAR-56 type) which are arranged in a predetermined pattern in the runway approach zone. Also included as part of the runway package are isolation transformers, junction boxes, an aiming device, flasher light units and control cabinets, and lampholders and shorting devices for each of the lights 19. The substation equipment package 15 includes a substation control and monitor 21, a high voltage input cabinet 23, a high voltage output cabinet 25, constant current regulators 27, 29, and 31 for regulating the current on each of the three lighting loops, a flasher master control cabinet 33, and a transformer and distribution panel 35. All of this equipment is preferably located in a substation building positioned near the end of the runway. Finally, the control tower equipment package 17 comprises a remote control panel 37 and a remote electronics chassis 39.

In operation, the remote control panel 37 permits control of the lighting system 11 from the control tower, and displays the operational status of the system. The remote electronics chassis 39, in the control tower, receives control and status signals through a telephone line 41 from the substation and processes them for display on the remote control panel 37. In turn, control signals from this panel are routed through the telephone line 41 to the substation. The high voltage input cabinet 23 receives high voltage three-phase input power from a power source through a power line 43 to operate the steady burning lights and flashing lights. AC input from the high voltage input cabinet 23 is provided to the three constant current regulators 27, 29, and 31 through a power line 45, as well as to the transformer and distribution panel 35 through a power line 47, and to the substation control and monitor 21 through a power line 49. The constant current regulators 27, 29, and 31 are used to power the three lighting loops. Each regulator can supply 50 kW output at 20 amperes. The regulators preferably have five intensity steps: 8.5 A, 10.3 A, 12.4 A, 15.8 A, and 20 A. The regulators can be operated by their own local control panel or remotely from the substation control panel 21 or the air traffic control tower control panel. Monitoring circuits detect the actual current flowing into the regulator output and supply intensity status signals to the control and monitor cabinet 21.

The high voltage output cabinet 25 distributes the output of the constant current regulators, which is received via power line 51, to the lighting loops, via power line 53. Each regulator output has a shorting disconnect to short both the regulator output and the lighting loops circuit during maintenance. Three high voltage relays, one for each lighting loop, switch to a portion of the lighting loops in the simplified short approach mode. The relays are controlled from the control and monitor cabinet 21. A monitoring bank of isolation transformers and reference lights 55 monitor the regulator output voltage by means of a sampling line 57, in a manner to be described more completely hereinbelow.

Other important system components include the flasher master controller 33, which controls operation of the sequenced flashers. The flashers can be operated from the control panel or remotely through the control and monitor cabinet 21. The master controller 33 can monitor the status of the flasher light units, as well as control the intensity thereof. A shorting device maintains the integrity of the 20 amp series circuit when a lamp burns out, by providing a short circuit around that non-functional lamp. One is located in each lampholder assembly. The substation control and monitor cabinet 21 contains the control and monitor circuitry to operate the flashing light system and the steady burning system. The control panel within the control and monitor cabinet 21 monitors the input voltage, input power, and regulator output voltages by use of meters. Control switches place the system into operation, select light intensity levels, and select between the two available modes. The panel displays system cautions and warnings and selection of local or control tower operation of the system. The switches on the control panel have integral lights. The lights work independently of the switch, so that when a switch is activated and a signal is received by the equipment, the equipment returns a signal turning on the light. For example, when brightness level 3 is selected, the brightness 3 indicator light will not illuminate until the constant current regulators 27, 29, and 31 return the signal that indicates they are operating at an intensity 3 current level.

The control and monitor cabinet 21 houses two racks of circuit card assemblies that contain the electronics required to perform control and monitor functions. These circuit card assemblies include a monitor alarm circuit board assembly which controls the monitoring process, as well as three monitor channel circuit board assemblies, one for each of the three lighting loops. The primary functions are:

a) to provide brightness selection of the lamps. The steady burning lamps operate on brightness 1 level for a short duration before stepping to the selected intensity. When brightness 5 is selected, the lights are automatically reduced to brightness 4 after a predetermined period of time;

b) to turn off the constant current regulators while changing modes in order to allow the high voltage relays in the high voltage output cabinet 25 to transfer without being loaded;

c) to transmit by telephone line 41 digital control and status signals to the control tower remote control panel, and to receive by telephone line digital control signals from the tower to operate the system; and d) to monitor the steady burning lights and detect lamp failures. This is accomplished by monitoring reference lamp voltage in each lighting loop as well as each loop voltage. Reference voltage signals from isolation transformers and reference lights 55 are passed to and monitored at control and monitor cabinet 21. A change in loop voltage caused by one or more failed lamps is detected and compared with the reference lamp voltage. When the number of failed lamps exceeds a preset number, a caution or failure signal is displayed on the control panels and an audible alarm is sounded. The monitor test panel is contained in the card racks. The meter on the panel provides a visual indication of the number of failed lamps. Screwdriver adjusted variable resistors located on the panel are preset to a known number of failed lamps and can be switched into the monitor circuitry to check their operation without disturbing the lighting field lamps.

The problem with the lighting system, as described above, is that the lamp failure detection method relies on the monitoring of the voltage level on each of the three lighting loops. This method of failed lamp detection has proven to be unsatisfactory for a number of reasons. The major problem is that this approach is very susceptible to the condition of the lighting loop cabling. Change in cable conditions caused by unavoidable occurrences such as changes in temperature, humidity, deterioration in insulation, and increase in the resistance across cable connections, as well as lamp aging, all result in incorrect detection of lamp failures. The reason for this is that the changes in cable insulation and corrosion of electrical connections result in an increase in the impedance of the loop. The constant current regulators 27, 29, and 31 correct this condition by increasing the regulator output voltage to maintain a constant current through the lighting system (of course, the ability of the system to compensate for this degradation is limited by the 50 kW capability of the constant current regulators). The failure of a lamp triggers the activation of the shorting device in the particular lamp holder, thereby reducing the total voltage across the affected lighting loop. However, the fact that the system voltage is continually adjusted by the constant current regulators in order to maintain a constant current across the loop as it degrades, will obviously diminish the ability of the monitoring circuits to detect the change in loop voltage caused by the lamp failure.

Another problem with the lamp failure detection system presently in use is the lengthy time required for installation and calibration. Approximately 73 potentiometer adjustments are required each time the system is installed or calibrated. Furthermore, even when the system is operating properly, only very limited information is available, i.e. that a threshold number of lamps have failed on one of the three lighting loops. No indication as to which specific lamp has failed is given. Calibration of the state of the art system is so cumbersome and time-consuming, and it remains calibrated for such a brief period of time, that some airports have disabled the monitoring circuitry and have resorted to a manpower intensive hourly visual monitoring of the light system.

SUMMARY OF THE INVENTION

This invention resolves the problems with the prior art system discussed above, by providing a unique approach to effectively monitoring the status of the system lights, for example, the steady burning system lights. It employs a known technology of transmitting data over power wiring. This technology has a significant advantage over other approaches in that no additional wiring is required when retrofitting the failed lamp detection subsystem in existing systems, other than the lighting loop power wiring currently used in the prior art system of FIG. 1. Thus, the present monitoring subsystems can be easily and effectively retrofitted into existing lighting systems. In addition, the present subsystems can be included in new lighting systems at the time of initial installation of such new lighting systems.

Another advantageous feature of the invention is that the monitoring system will operate properly in spite of degradation in the condition of the lighting loops, since it relies on positive signal tones from an active circuit at each lamp, rather than measuring the voltage across the lighting loop and comparing it to a reference voltage.

Yet another feature of the invention is that the inventive system identifies the individual light that has failed, and permits the monitoring of cautions and failures in all combinations desired, depending upon the application.

Other advantages include an ability of the system, following a lamp failure, to indicate the status of the shorting device associated with the failed lamp and to report a failure in its operation. Also, all circuitry required to monitor the lamps is mounted within the lamp housing, and is simple, reliable and inexpensive. Importantly, no calibration or maintenance is required, particularly because the timing of the reporting system is derived from the zero crossings of conventional ac power, for example, 60 Hz ac power. Also, the tone frequencies transmitted on the power lines are crystal controlled. No reference lamps are required. Finally, the use of a micro-controller to control the monitor subsystem permits flexibility in the type and format of the data reported.

Now with reference to the invention, in a lighting system having a plurality of lamps which are interconnected by power lines, a subsystem for detecting the failure of one or more of the lamps is provided. The subsystem comprises a subsystem processor and a plurality of lamp transceivers equal to the number of lamps in the lighting system, with each of the lamps being associated with a corresponding transceiver. A key aspect of the invention is that the lamp transceiver, which is co-located with its corresponding lamp, relays information concerning the operability of its corresponding lamp over the lighting system power lines to the subsystem processor.

In another aspect of the invention, a lighting system having a plurality of lamps which are interconnected by power lines is provided with a subsystem for detecting the failure of one or more of the lamps and providing specific information regarding the failure of particular lamps to a system operator. Preferably, the subsystem is configured for substantially modular installation into the lighting system without the need to modify the function of any remaining system components. More specifically, the subsystem preferably comprises of at least one circuit card assembly configured to fit precisely into a location in which at least one circuit card assembly for a previously installed failure detection subsystem which is to be replaced is positioned. The fact that installing (or retrofitting) the inventive subsystem involves merely the installation of a few circuit card assemblies, as well as a slight modification of the shorting devices within the lampholders, makes it even more desirable.

Yet another aspect of the invention is a method for detection the failure of one or more of a plurality of lamps which are interconnected by power lines. The method comprises the steps of transmitting a synchronization pulse over the power lines to the plurality of lamps, resetting a binary counter at each of the lamps responsive to the synchronization pulse, incrementing each of the binary counters through a count equal to the number of interconnected lamps, and generating a tone at each of the lamps at a predetermined frequency when the corresponding binary counter to each of the lamps reaches a count equal to a numerical identifier for that particular lamp, when that particular lamp is operative. Additional steps include transmitting each tone over the power wires back to a processor, and processing each of the tones received from the lamps. A caution or failure alarm is preferably activated if a predetermined number of lamps are indicated as having failed.

The invention, together with additional features and advantages thereof, may best be understood by reference to the following description taken in connection with the accompanying illustrative drawings. Although the present invention is described with reference to, and has particular applicability to, airport lighting systems, it is also applicable to any other application in which it would be desirable and/or advantageous to monitor the status of a plurality of lamps interconnected by power lines.

DETAILED DESCRIPTION OF THE INVENTION

Figure 1:
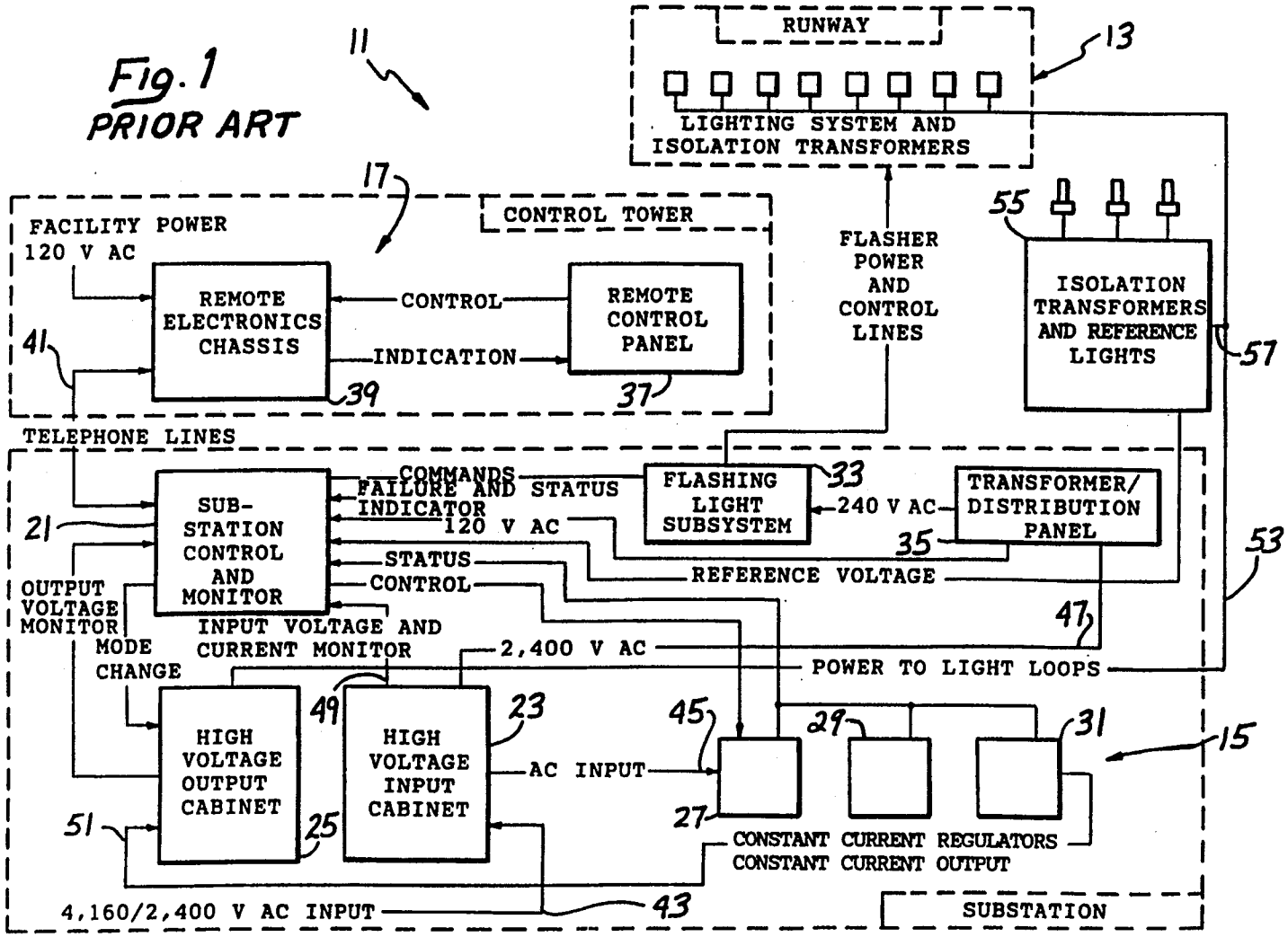
Fig. 1 PRIOR ART
FIG. 1 is a schematic view illustrating a prior art dual mode high intensity aircraft approach lighting system of the type which the present inventive lamp failure detection subsystem is designed to enhance.
Figures 2, 3:
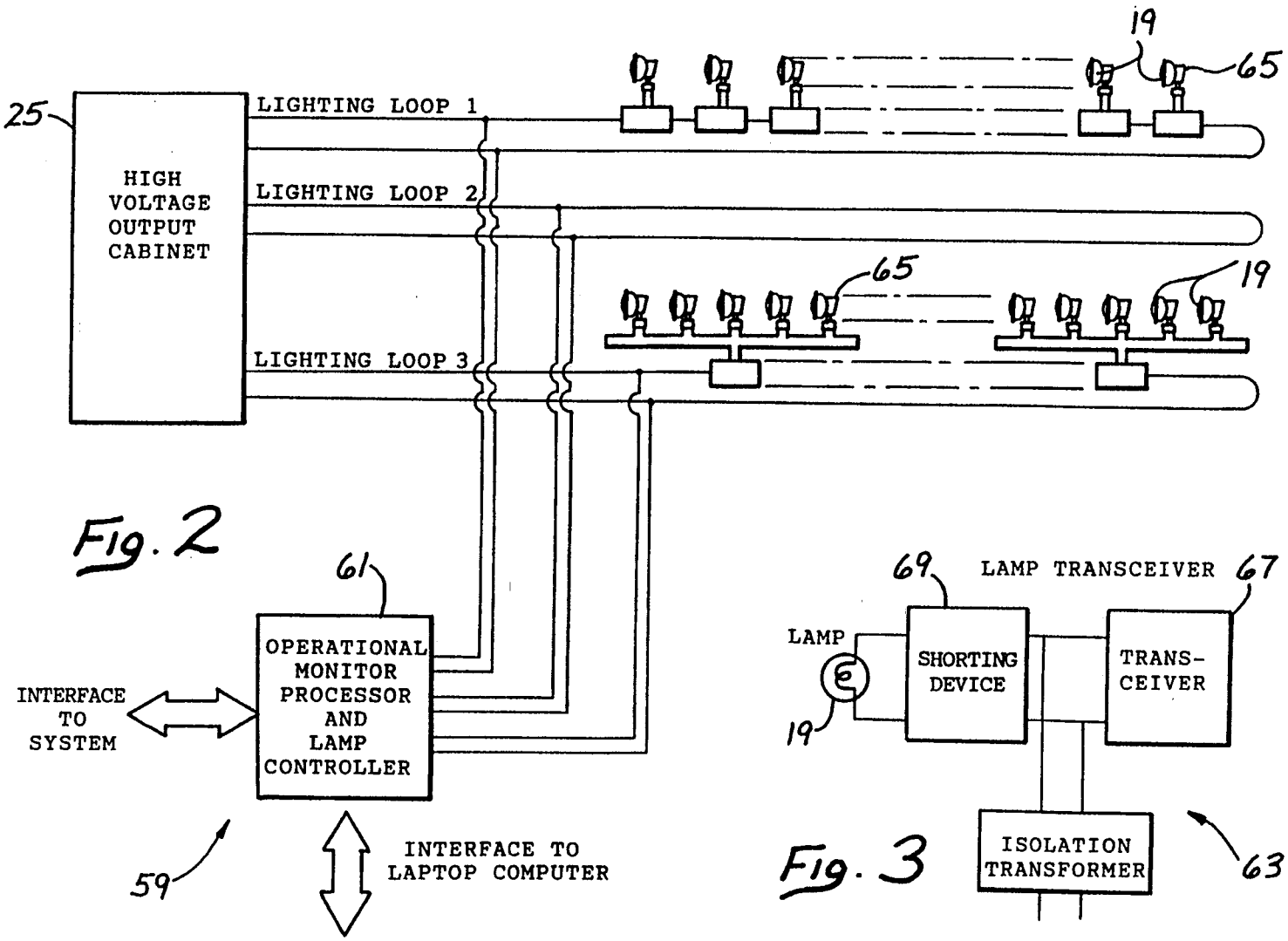
FIG. 2 is a schematic view illustrating the general arrangement of the inventive lamp failure detection subsystem.
FIG. 3 is a schematic view of a lamp transceiver which forms a portion of the inventive subsystem.
Figure 4:
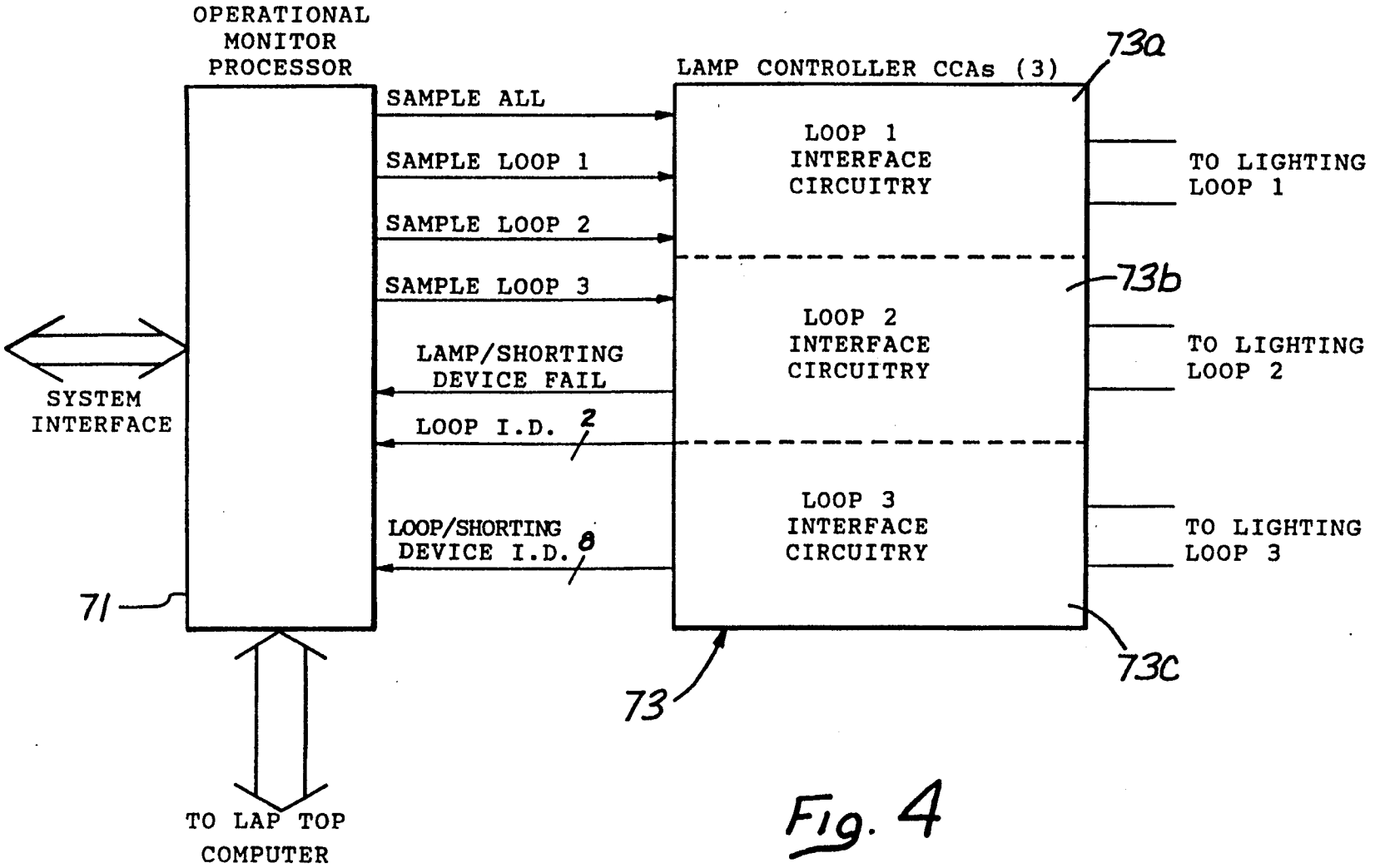
FIG. 4 is a schematic diagrammatic view illustrating the interaction between the operational monitor processor and the lamp controllers which comprise the operational monitor processor and lamp processor shown in FIG. 2.
Figure 5:
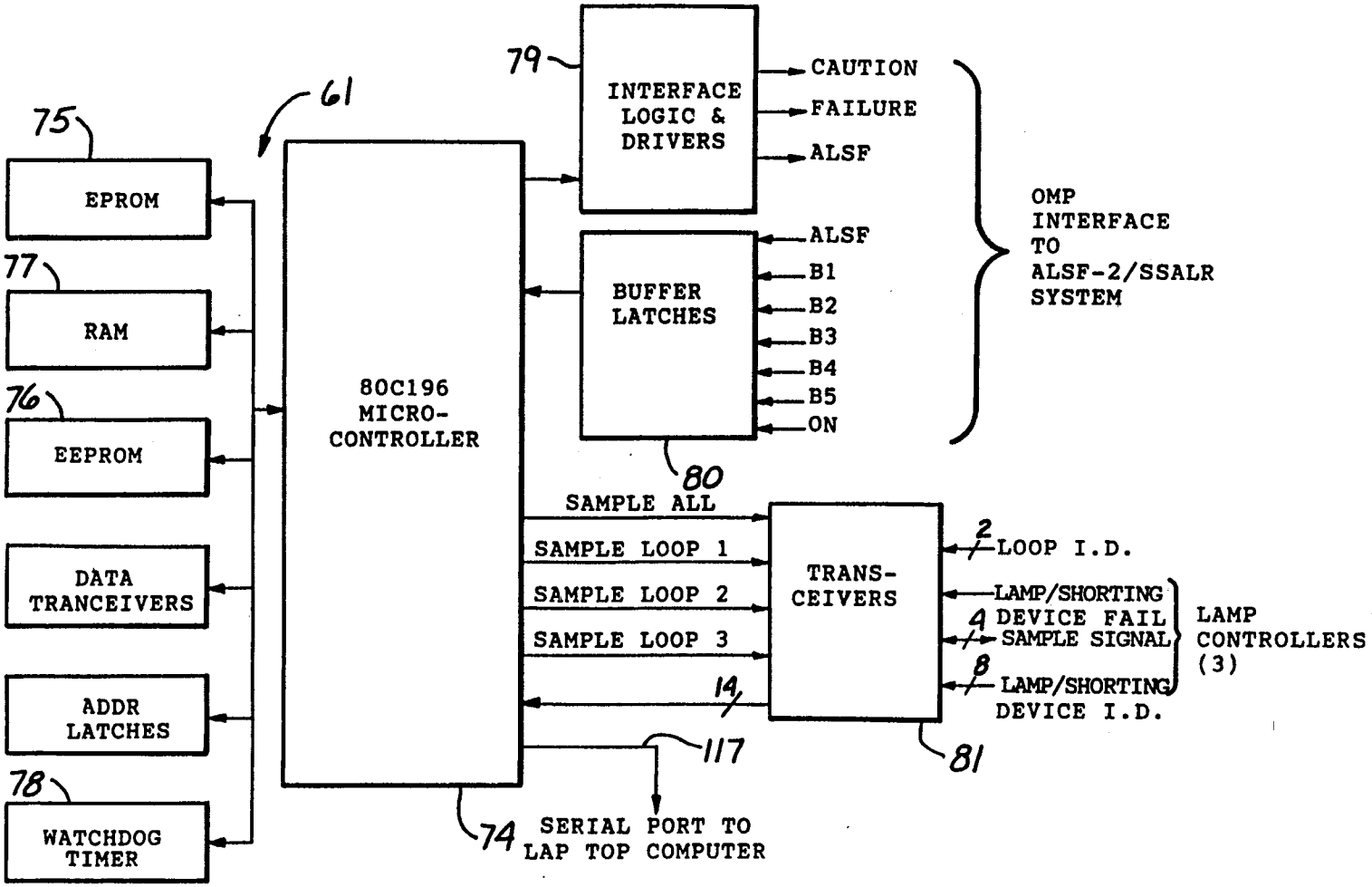
FIG. 5 is a schematic diagrammatic view showing the components of the microcontroller which forms the basis of the operational monitor processor shown in FIG. 4.

One great advantage of the inventive lamp failure detection subsystem is the ease with which it may be adapted to (retrofitted in) a lighting system of the type shown in prior art FIG. 1. No existing components need be substantially modified, nor is additional wiring required, since the subsystem operates using the existing lighting loop power wiring. The operational monitor subsystem 59 is illustrated in FIGS. 2, 3, 4, and 5. The subsystem 59 consists of an operational monitor processor and lamp controller module 61 (FIG. 2), and a plurality of lamp transceiver modules 63 (FIG. 3), one of which is located in the lampholder 65 of each lamp 19. Each lamp transceiver module 63 includes a transceiver circuit 67 as well as a shorting circuit 69. The operational monitor processor and lamp controller module 61 comprises two types of circuit card assemblies, one of which functions as an operational monitor processor 71, while the other functions as a lamp controller 73 (FIG. 4). The operational monitor processor circuit card assembly 71 is preferably installed in the substation control and monitor cabinet 21 (FIG. 1), in the circuit card location previously occupied by the monitor alarm circuit board assembly used in the existing lighting system, which is removed upon installation of the inventive monitoring system circuit. To ensure that this modification does not affect the operation of the existing lighting system, the operational monitor processor circuit card assembly provides the identical outputs, on the same connector pins as the prior alarm circuit board. It also makes use of all inputs to the alarm circuit board to generate the corresponding outputs.

The lamp controller 73 preferably comprises three lamp controller circuit card assemblies 73*a*, 73*b*, and 73*c*, one for each of the three constant current lighting loops. These assemblies 73*a*, 73*b*, and 73*c* are also installed in the substation control and monitor unit 21, in the locations previously occupied by the three monitor channel circuit board assemblies used in the existing lighting system. Again, to ensure that this modification does not affect the operation of the existing system, each of the three lamp controller circuit card assemblies 73*a*, 73*b*, and 73*c* provide those outputs which are currently generated by the monitor channel circuit boards.

Furthermore, the operational monitor processor circuit card assembly 71 and the lamp controller circuit card assemblies 73*a*, 73*b*, and 73*c* are interconnected electrically by means of ribbon cables connected between each circuit card assembly. This method is used to ensure that no wiring modifications are necessary to the existing substation control and monitor cabinet 21 (FIG. 1). Thus, one key feature of the invention is that the entire operational monitor subsystem and lamp controller circuity can be installed in the system shown in FIG. 1 merely by replacing four existing circuit board assemblies with four new ones. As noted above, not only can the present inventive subsystems be retrofitted into existing lighting systems, but new lighting systems including such subsystems can also be installed and used. Thus, subsystems for retrofitting and subsystems for inclusion as components in new lighting systems are included within the scope of the present invention.

The function of the operational monitor subsystem 59 and associated software is to monitor the status of the approach landing system lights 19 and the shorting devices 69, and it communicates in half duplex by imposing a series of tones on the power wiring of the lighting system. A 16 kHz pulse/tone is transmitted to all lamp locations on one of the three lighting loops. Each lamp transceiver circuit 67 responds back to the lamp controller. Two separate transmissions occur from each transceiver. The first reports the status of each light. The lamp voltage is filtered and the voltage level is monitored by a voltage comparator included in each transceiver. This voltage comparator distinguishes between the voltage across a functioning lamp and the higher voltage that occurs when a shorting device activates. Thus, the voltage level dictates which first transmission is sent from the transceiver. The second transmission reports the status of any shorting devices. If the shorting device is operating (active), a positive second transmission will be given, while if the shorting device is inactive or broken, no second transmission will be given. The monitor subsystem design preferably has the capability of up to 127 lamps and 127 shorting devices on each lighting loop. Since the basic timing of the transceiver is derived from the 60 Hz ac power, the time required for both transmissions is about 4.27 seconds. The interrogation of the first lighting loop is followed by the interrogation of the second and third loops. A total of 12.8 seconds is required for a complete interrogation of the entire system.

The operation of the lamp monitoring subsystem 59 is controlled by the operational monitor processor 71, as particularly shown in FIG. 4. Its operation is preferably based upon the use of an 80C196 microcontroller 74 (FIG. 5), manufactured by Intel, Inc. of Santa Clara, Calif., which is a highly integrated 16-bit processor that runs at 12 MHz. Because of its integrated structure, including 28 interrupt sources, five 8-bit I/O ports, four 16-bit timers, full duplex serial port, and 10-bit A/D converter with sample/hold, the processor requires a minimum of support hardware to perform its various functions. It is equipped with two 256K-by-8 bit EPROM components 75 to store the system software, four 8k-by-8 bit EEPROM components 76 to store system parameters and accumulated reference data which are maintained during power outage, and two 8K-by-8 bit RAM components 77 which are used for temporary data storage that is required to support data transfer and data processing. The operational monitor processor 71 also includes a watchdog timer 78, which is in effect a retriggerable multivibrator that will monitor the performance of the processor and generate a reset if not serviced periodically. This is implemented in discrete logic so as to maintain autonomy from the processor. Many of the individual hardware components included in the subsystem 59 can be selected from commercially available components that are known to be useful to perform similar or analogous individual functions.

The operational monitor processor 71 interfaces with the lighting system control components, such as the substation control and monitor 21, the control tower remote electronics chassis 39 and remote control panel 37, and other components by means of interface logic and drivers 79 and buffer latches 80. The processor 71 further interfaces with the lamp controller circuit card assemblies 73*a*, 73*b*, and 73*c* by means of transceivers 81.

The monitoring of the lighting system is initiated by sending a SAMPLE ALL command to the lamp controller 73. The lamp controller then sequentially interrogates each of the three lighting loops. The operational monitor processor 71 is subsequently notified of any failure condition by the occurrence of a DEVICE FAIL signal. When a failure occurs, the lamp controller interface is read to access two bits of information indicating the loop on which the failure occurred, and eight bits that indicate the identification of the lamp location, and if the failure is in a light or a shorting device. Continuous monitoring of received status data may be performed without the occurrence of the DEVICE FAIL signal to assist in installation and fault isolation.

Figure 6:
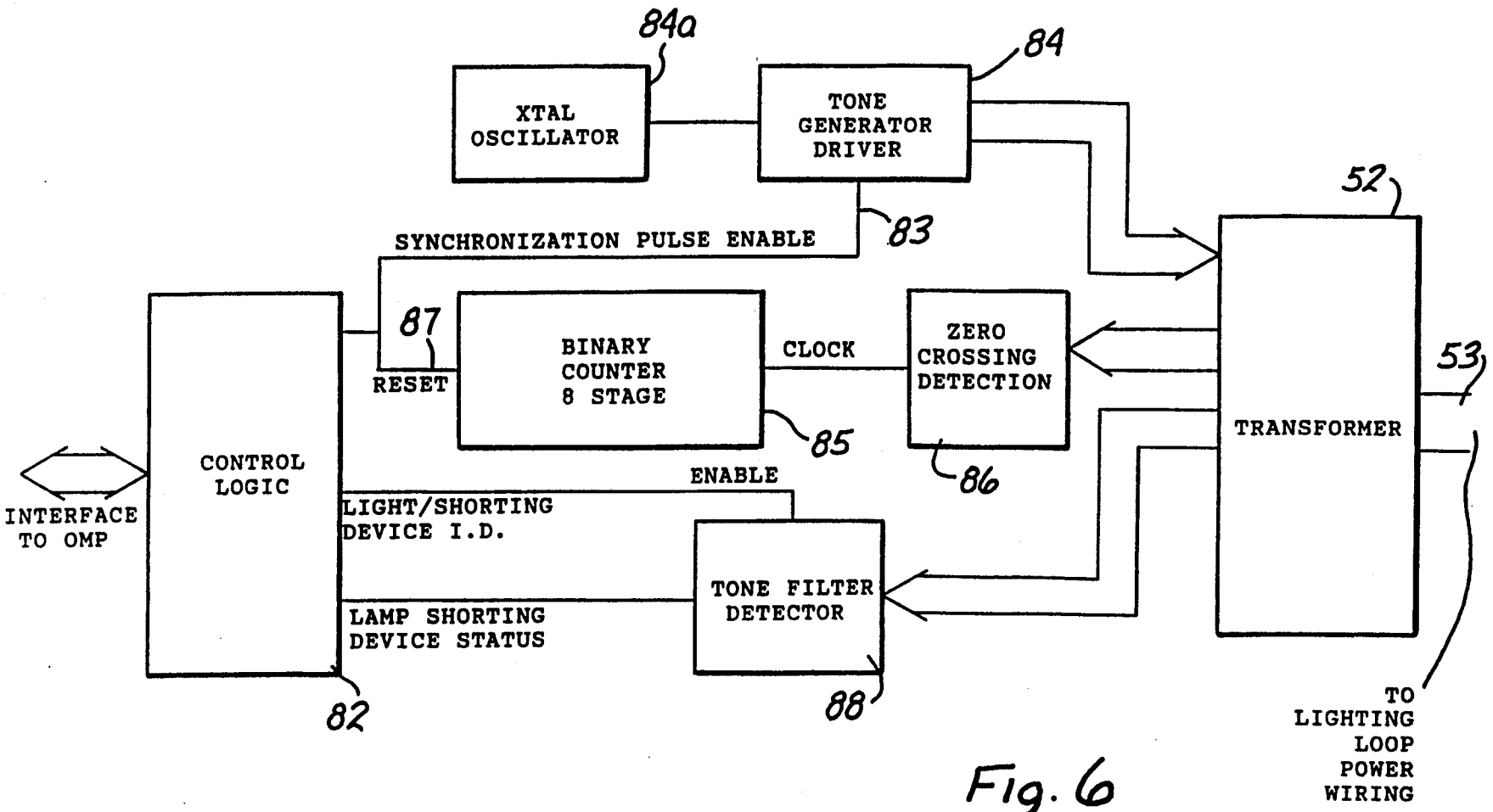
FIG. 6 is a schematic view illustrating the operation of the lamp controller circuit card assemblies which are shown diagrammatically in FIG. 4.

Referring now to FIG. 6, the lamp controller 73 contains three lamp controller circuit card assemblies 73*a*, 73*b*, and 73*c*, as described above, which each contain the circuitry required to interrogate one of the three separate lighting loops. In addition, each circuit card assembly contains control logic 82 to sequence through each loop and to interface with the operational monitor processor 71. FIG. 6 indicates the major functional circuits that are required. The process is initiated by the SAMPLE ALL pulse (FIGS. 4 and 5) that triggers a synchronization pulse enable signal via a control line 83 to a tone generator driver 84, resulting in the generation and transmission of a 16 kHz synchronization pulse/tone via the transformer 52 to the lighting loop power wiring 53. A crystal oscillator 84*a* regulates the frequency of the pulse/tone generated by the tone generator driver 84. The SAMPLE ALL pulse also resets an eight bit binary counter 85 that is clocked on each succeeding zero crossing of the 60 Hz ac power detected by a zero crossing detector 86, via a control line 87. The zero crossing detector 86 monitors the 60 cycle voltage across the terminals of the isolation transformer 52 and detects the point of zero voltage crossing. The output is a logic level 60 cycle square wave. This 60 cycle clock (16.7 msec) is used as the frame clock for data transmission and reception of the lamp controller. The half cycle during which this 60 Hz signal is high defines the transmit period of each transponder. At the anticipated time of response from each light, an 8 kHz tone filter and detector 88 is enabled. The output of the detector indicates the status of each light. This status, as well as the status of the binary counter 85, is processed by the control logic 82 to notify the operational monitor processor 71 of failures and of the identification of the failed device.

Figure 7:
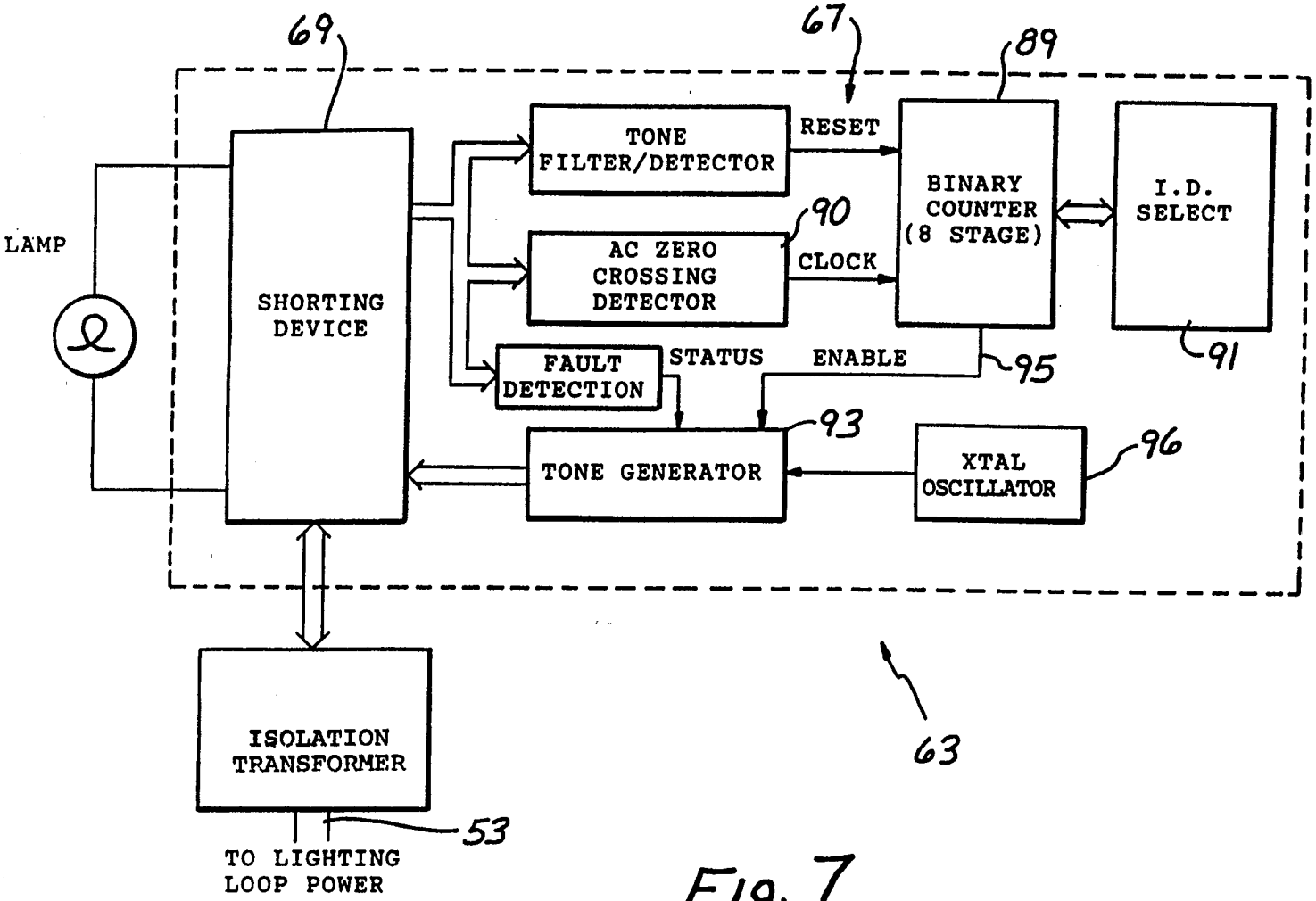
FIG. 7 is a schematic view showing the operation of the lamp transceiver circuit which is co-located with each lamp in the lighting loop.

Now with reference to FIG. 7, the lamp transceiver module 63 is illustrated, which consists of the solid state shorting device circuitry 69 and the transceiver circuitry 67 required to respond to the interrogations of the lamp controller 73 (FIG. 6). The transceiver circuitry 67 is similar to that of the lamp controller in that an eight bit counter 89, incremented at each zero crossing of the 60 Hz power, by means of an ac zero crossing detector 90, is the basis of the device timing. The zero crossing detector 90 monitors the 60 cycle voltage drop across the lamp terminals and detects the point of zero voltage crossing. The output is a logic level 60 cycle square wave. This 60 cycle clock is used as the frame clock for data transmission and reception of the transceiver. The half cycle during which this signal is high defines the transmit period of the transponder. The counter is enabled by the reception of the 16 kHz synchronization pulse/tone from the lamp controller 73, which is received by means of the lighting loop power lines 53. The counter increments through a count equal to the number of lights on each lighting loop (127 in the preferred embodiment), for each synchronization pulse received. At the second occurrence of count 127, the counter 89 is inhibited until the next synchronization pulse is received from the lamp controller 73.

Following the reception of the synchronization tone, the counter increments until its count corresponds to the numerical identification (ID) of the specific light. The ID is preassigned to each light location of the lighting system and is installed into the transceiver during installation of the monitoring system by means of seven shorting plugs in an ID select module 91, which permits the selection of an ID from 1 to 127. When the counter state corresponds to the assigned ID, a tone generator 93 is enabled by the counter through a control line 95 to generate a 8 kHz crystal controlled tone for transmission back to the lamp controller 73 through the power wiring 53, depending upon the status of the light 19 and the shorting device 69. A crystal oscillator 96 regulates the frequency of the controlled tone generated by the tone generator 93. During the first cycle of the counter, the tone is transmitted if the light is operating properly. During the second cycle of the counter, the tone is transmitted if the light has failed and the shorting device has also failed.

Figure 8:
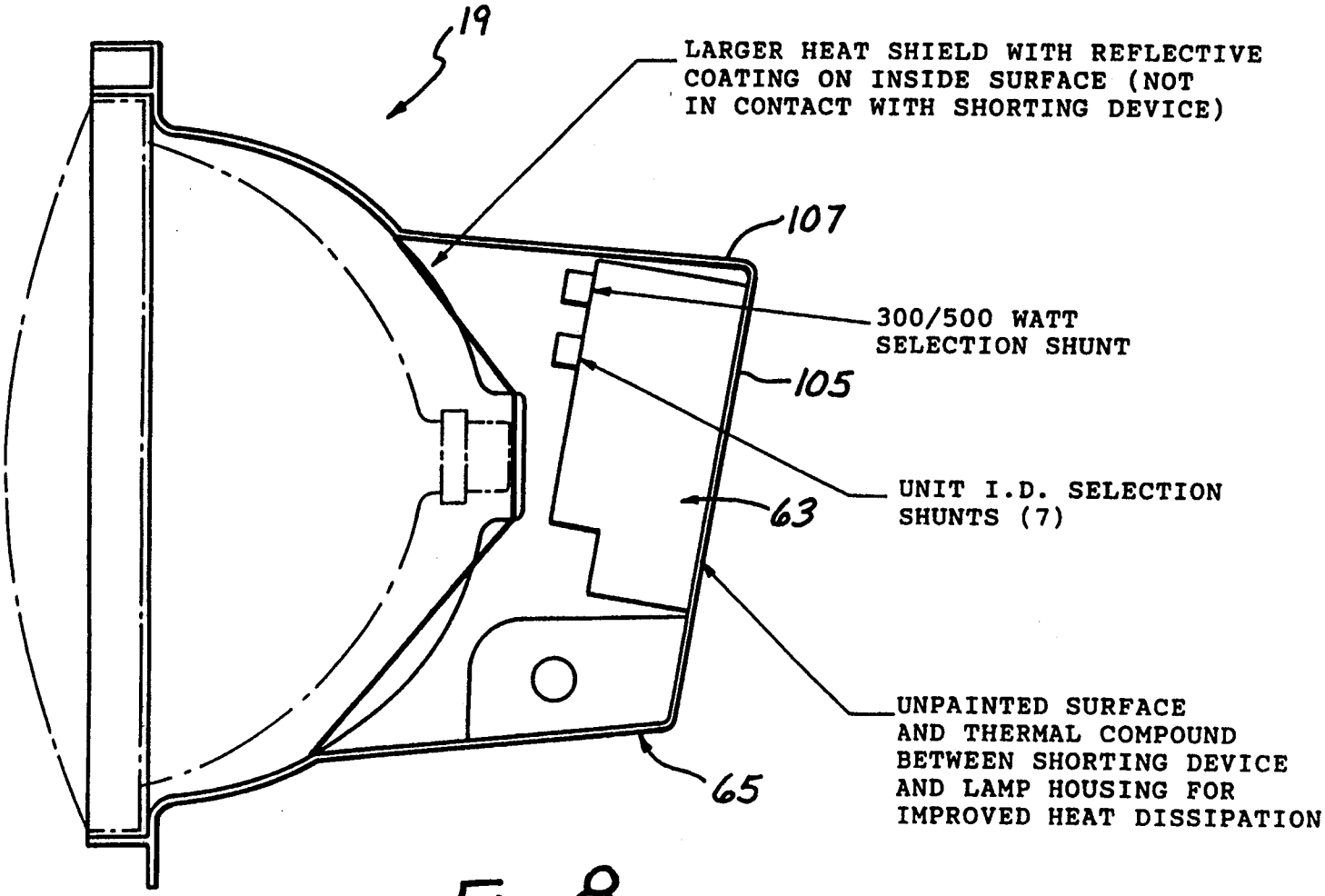
FIG. 8 is a diagrammatic view in plan showing some construction details of the lampholder for each lamp in the lighting loop.
Figure 9:
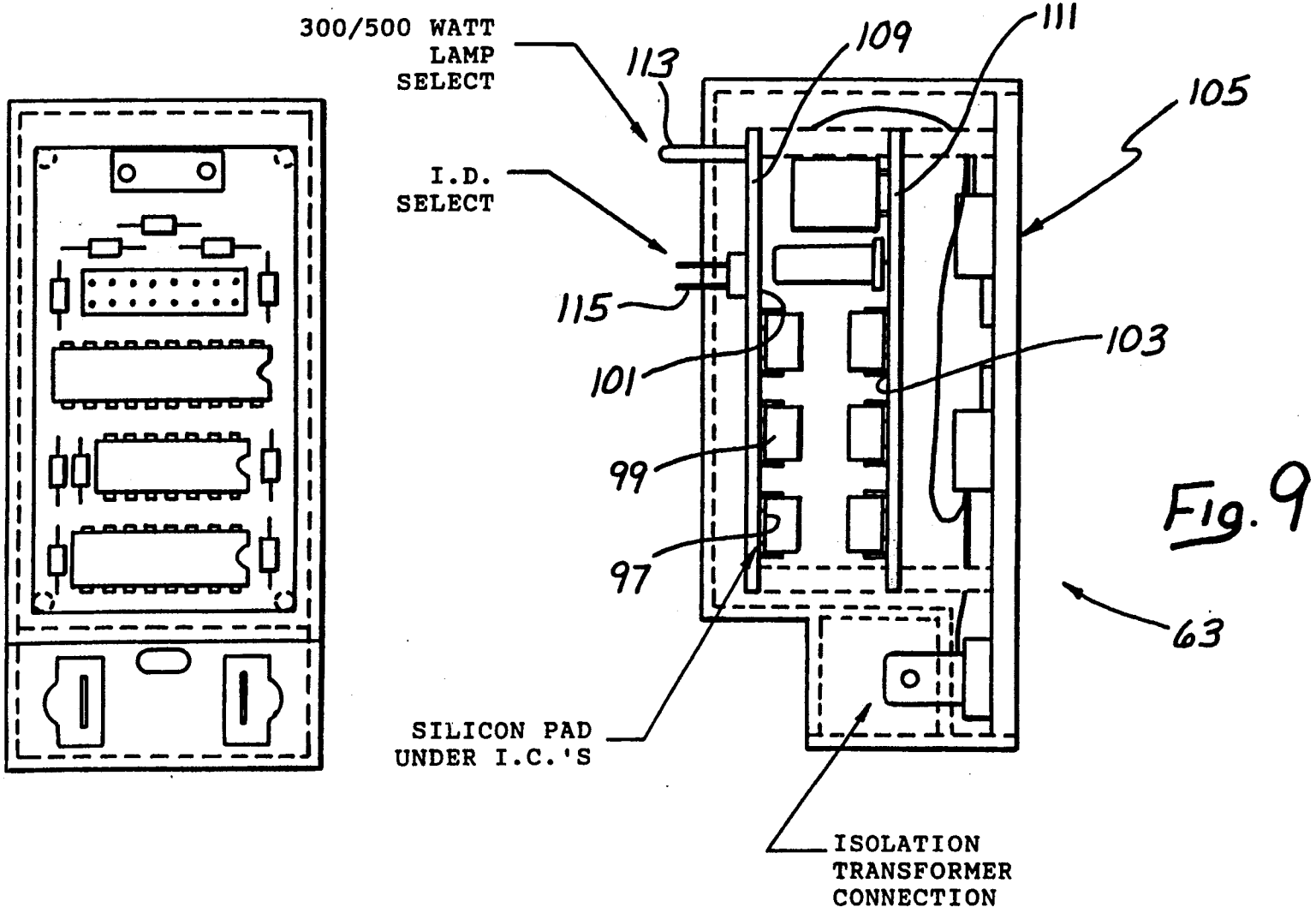
FIG. 9 is a cross-sectional view showing further details of the lampholder construction.

FIGS. 8 and 9 illustrate important features regarding the mechanical installation of the lamp transceiver module 63 in the lampholder 65. Essentially, a larger potted module 63 replaces the smaller unit used in the prior art system of FIG. 1, which contains only a shorting device. The most significant concerns in the packaging of the circuitry is heat dissipation and the limited space available in which to mount the circuitry. Of particular concern is a short duration rise in temperature that occurs when a light fails and the shorting device 69 activates. Under these conditions, the temperature may rise to as much as 115 degrees C. for approximately ten minutes. Consequently, thermally conductive silicon pads 97 are inserted beneath all active integrated circuits 99 (comprising both the transceiver circuit 67 and the shorting device 69) to ensure a good thermal path to mounting surfaces 101 and 103 (FIG. 9). Furthermore, the transceiver base 105, which comprises an aluminum heat shield, is anodized but left unpainted. A thermal compound of a well known type, such as Wakefield 120-2 manufactured by EG&G Wakefield Engineering, may be used between the base 105 and the housing 107 of the lamp to ensure proper thermal conductivity.

The transceiver circuitry is mounted on two circuit card assemblies 109 and 111 as illustrated in FIG. 9. Because of the large quantities of power they must dissipate, the components required for the shorting device are mounted directly to the aluminum heat shield 105 at the bottom of the module 63. At installation, two functions are programmed on the module. The first is the ID of the lampholder 65. The second is the selection of lamp size (either 300 or 500 watts). The selection of these functions is by means of the installation of shorting bars on headers 113, 115 protruding through the top of the potted module.

As noted above, the EPROM components 75 store the system software necessary to operate the inventive lamp failure monitoring subsystem. Status data for failed lamps and shorting devices are received from the lamp controller hardware. The software collects data on faulty lamps, shorting devices, brightness level selected and elapsed time in brightness modes. This data is stored in non-volatile memory. The lamp failure detection software uses a data translation matrix derived from the known position of each lamp/shorting device in the lighting system. This matrix, using the lamp/-shorting device ID, allows the software to quickly determine the exact position of any failed lamp/shorting device in the system relative to any other failed lamp/-shorting device. Consequently, the operational monitor 71 not only may quickly identify lamp alarms/alerts, but also may easily accommodate any changes to lamp or lamp bar caution or failure threshold criteria. The detection software can also be modified to support unique approach lighting systems which do not contain the standard number or placement of lamps.

The preferred method for interacting with the system software is by means of a laptop computer, connectable to the microcontroller 74 through a serial port 117. Using the laptop computer, a field service technician has the ability to modify system modes, alarm/alert parameters, reset lamp life timers, and check the status of specific lamps. More specifically, the technician can select the proper software lamp matrix for either the 2400 ft. or 3000 ft. lighting mode. He or she can also modify the error count to determine cautions/failures. This command allows the technician to select the number of consecutive failure indications from a specific lamp or shorting device that is required before the sequence of failures is used to alert the system operator as to lamp system cautions/failures. This feature permits noise free and reliable detection of lamp failures for all system noise conditions. For example, if the error count is set to three, a lamp in the system must return an error condition for three consecutive monitoring cycles before the lamp would be considered non-functional. After the third status the detected lamp failure would be used in the generation of alarms to the system operators.

A third software modification which the technician can make is to modify the failure reporting criterion to meet current government safety regulations. Thus, for each of the two lighting system modes, the number of lamp failures necessary to generate a caution alarm, and the higher number of lamp failures necessary to generate a failure alarm, may be easily adjusted as desired.

Other unique features of the inventive subsystem is the ability to display lamp life data, i.e. the total time an individual lamp or shorting device has been in operation. With this feature, a system operator can determine which lamps might require preventive maintenance. The operator can select the display of all lamps which have reached a specific level of use. A separate software command permits the operator to reset the individual lamp timers.

Yet another unique feature of the subsystem is the ability the operator has to check specific lamps for operation. This feature will be especially useful in verifying the operation of a lamp that has been replaced.

Now to summarize the operation of the operational monitor subsystem 59, the subsystem hardware consists of an operational monitor processor circuit card assembly 71 and associated operational software, three lamp controller circuit card assemblies 73*a*, 73*b*, and 73*c*, one remote lamp transceiver module 63 per lamp 19, and existing ac loop wiring which is part of the dual-mode approach lighting system 11 (FIG. 1). The operational monitor processor circuit card assembly 71 initiates a reset of the lamp controller circuit card assemblies 73*a*, 73*b*, and 73*c*, as well as the remotely installed lamp transceiver modules 63 by sending a SAMPLE ALL signal to each lamp controller circuit card assembly. A comprehensive test of all lamps in each of the three lighting loops is performed. The first lamp controller circuit card assembly 73*a* sequentially polls each lamp 19 in the first loop for operational status. If the lamp is operative, it responds when polled with an 8 kHz tone. Then, each shorting device 69 in the first loop is sequentially polled by the first lamp controller circuit card assembly 73*a* for operational status. If a shorting device for a particular lamp is not operative, it responds when polled with an identical 8 kHz tone. Upon completion of polling the first lighting loop, the second lamp controller circuit card assembly 73*b* automatically tests the second loop, and subsequently the third by the third circuit card assembly 73*c*. Any instance of a failed lamp or shorting device generates a signal to the operational monitor processor 71. The operational monitor processor 71 has up to 8 msec to read the data port on the specific controller circuit card assembly. The data word format of the failed condition includes the lighting loop number, a lamp number within the associated loop, as well as the failed lamp status.

The light monitoring subsystem described and claimed herein is easily installed into existing steady burning lamp lighting systems, and offers a unique approach having significant advantages and features related to the problem of successfully monitoring the status of steady burning lights in an approach landing lighting system of the type illustrated in prior art FIG. 1. The common technology is the transmission of data over power wiring. This method has been successfully used in various commercial and aviation applications. It has significant advantages over other approaches in that no additional wiring is required other than the lighting loop power wiring currently used in the FIG. 1. system. To retrofit an existing system, no modifications are required to existing system units, other than the replacement of four circuit card assemblies and the existing shorting device in each lampholder.

Another significant advantageous feature is that the monitoring subsystem will operate properly in spite of degradation in the condition of the lighting loops. Yet another advantage is that the system identifies which individual light has failed, rather than just that one or more lights have failed, and permits the monitoring of cautions and failures in all combinations required. The monitoring and cautions and failures configurations are entered into the system by means of a laptop computer or the like, which can also be used to monitor the status of the system. Additionally, following a light failure, the system will indicate the status of the shorting device if the location is so equipped and report a failure in its operation. Also, all of the circuitry required to monitor the lamps is mounted within the lamp housing, and is simple, reliable, and inexpensive.

One of the more important features of the inventive subsystem is that no calibration or maintenance is required. The timing of the reporting system is derived from the zero crossings of the 60 Hz ac power and the tone frequencies transmitted on the power lines are crystal controlled for utmost reliability.

It should be noted that the reference lamps required by the prior art monitoring system are eliminated, thereby simplifying the system and increasing its reliability. Finally, the use of a microcontroller to control the monitor subsystem permits flexibility in the type and format of the data reported.

Although an exemplary embodiment of the invention has been shown and described, many changes, modifications, and substitutions may be made by one having ordinary skill in the art without necessarily departing from the spirit and scope of this invention. For example, although the invention has been disclosed as being useful in conjunction with a dual mode high intensity approach lighting system, it could equally well be applied to any multi-lamp lighting system. For this reason, the invention is only to be limited in accordance with the following claims.

What is claimed is:

1. A subsystem for detecting the failure of one or more lamps useful in conjunction with a lighting system having a plurality of said lamps which are interconnected by power lines, said power lines being connected to a source of electrical power and providing electrical power to said lamps, said subsystem comprising:

a subsystem processor; and a plurality of lamp transceivers equal to the number of lamps in said lighting system, each of said lamps being associated with a corresponding transceiver;

wherein said lamp transceiver relays information concerning the operability of its corresponding lamp over said power lines to the subsystem processor.

2. A subsystem as recited in claim 1, wherein each of said lamps is held in a predetermined position by an associated lampholder having a housing, said lampholder housing containing the lamp transceiver corresponding to its associated lamp.

3. A subsystem as recited in claim 1, wherein said subsystem processor activates an alarm when a predetermined number of lamp transceivers relay to said processor that their corresponding lamps are inoperative.

4. A subsystem as recited in claim 2, wherein each said lampholder housing further contains a shorting device which is designed to activate upon the failure of the associated lamp, thereby serving to short-circuit said lamp and maintain the operability of the remaining interconnected lamps.

5. A subsystem as recited in claim 4, wherein each said lamp transceiver further relays information to said subsystem processor concerning the operability of its corresponding shorting device when said corresponding lamp has failed.

6. A subsystem as recited in claim 1, wherein said subsystem processor comprises an operational monitor processor and a lamp controller, said operational monitor processor signalling said lamp controller to sequentially interrogate said lamps to activate a failure detection monitoring cycle.

7. A subsystem as recited in claim 6, wherein to initiate a failure detection monitoring cycle, said operational monitor processor initiates a command to said lamp controller, which in turn triggers a synchronization pulse that travels over said power lines to each said lamp transceiver, thereby activating each said lamp transceiver to provide a responsive signal back through said power lines to said lamp controller when its corresponding lamp is operative.

8. A subsystem as recited in claim 7, wherein said lamp controller and said lamp transceiver circuits both include a binary counter and a zero crossing detector, said lamp transceiver circuit further including an identification select module for assigning a particular numerical identification to its corresponding lamp, wherein said command resets said lamp controller binary counter and said synchronization pulse resets said lamp transceiver binary counter, each of said zero crossing detectors monitoring the 60 Hz ac power supplied to said system and being incremented each time the point of zero voltage crossing is detected, said zero crossing detectors in turn incrementing their corresponding binary counters, wherein each of said counters, upon being reset, is configured to increment through a count equal to the number of said lamps, said transceiver counter triggering a signal tone to said lamp controller over the power lines when its count corresponds to the numerical identification of its specific corresponding lamp and said lamp controller counter identifying from which lamp the tone originated according to its corresponding count, such that the precision of the 60 Hz ac clock results in an identification of the status of each particular lamp.

9. A subsystem as recited in claim 7, wherein said lamp controller and said lamp transceiver circuits both include a tone generator and a tone filter/detector, said lamp controller tone generator generating said synchronization pulse at a predetermined frequency while said lamp transceiver tone generator generates said responsive signal at a predetermined frequency, said tone filter/detectors being set to receive and identify the synchronization pulse or response tone generated by the other circuit, each of said tone generators being regulated by crystal oscillators.

10. A subsystem as recited in claim 6, wherein said lighting system comprises a plurality of lighting loops, said lamp controller sequentially interrogating each of the lamps in each loop and also sequentially interrogating each of the loops in turn.

11. A subsystem as recited in claim 10, wherein each said lampholder housings further contains a shorting device which is designed to activate upon the failure of the associated lamp in order to short-circuit the lamp and maintain the operability of the remaining interconnected lamps in the same loop, each said transceiver relaying information to said subsystem processor concerning the operability of both the corresponding lamp and the corresponding shorting device in turn, such that said lamp controller sequentially interrogates each of the lamps in a first loop, then sequentially interrogates each of the shorting devices in the same loop, following which the same interrogation procedure is repeated sequentially for each remaining loop or loops.

12. A subsystem as recited in claim 1, wherein said subsystem processor includes operational software associated therewith, said operational software permitting an operator to manipulate said subsystem in order to derive flexible data formats according to information requirements, and further permitting said operator to change the parameters resulting in a caution or failure alarm, in order to respond to altered requirements.

13. A lighting system having a plurality of lamps which are interconnected by power lines, said power lines being connected to a source of electrical power and providing electrical power to said lamps, said lighting system including a subsystem for detecting the failure of one or more of said lamps and providing specific information over said power lines regarding the failure of particular lamps to a system operator, wherein said subsystem is configured for substantially modular installation into said lighting system without the need to modify the function of any remaining system components.

14. A lighting system as recited in claim 13, wherein said subsystem comprises at least one circuit card assembly configured to fit precisely into a location in which at least one card assembly for a previously installed failure detection subsystem which is to be replaced is positioned.

15. A lighting system as recited in claim 13, wherein said subsystem utilizes only existing system power lines to communicate status information between each said lamp and a subsystem processor.

16. A lighting system as recited in claim 13, wherein said subsystem includes a processor and a plurality of lamp transceivers equal to the number of lamps in said lighting system, each of said lamps being associated with a corresponding transceiver, such that each said lamp transceiver relays a signal indicative of the operability of its corresponding lamp over said power lines to the subsystem processor.

17. A lighting system as recited in claim 13, which includes a dual mode high intensity approach lighting system for guiding aircraft during their approach to an airport runway.

18. A method for detecting the failure of one or more lamps useful in conjunction with a lighting system having a plurality of said lamps which are interconnected by power lines, said power lines being connected to a source of electrical power, said method comprising:

a) transmitting a synchronization pulse over said power lines to said plurality of lamps;
b) resetting a binary counter at each of said lamps responsive to said synchronization pulse;
c) incrementing each said binary counter through a count equal to the number of interconnected lamps;
d) generating a tone at each of said lamps at a predetermined frequency when the corresponding binary counter to each said lamp reaches a count equal to a numerical identifier for that particular lamp, when said particular lamp is operative;
e) transmitting each said tone over said power wires back to a processor; and
f) processing each of the tones received from said lamps and activating a caution or failure alarm when a predetermined number of lamps are indicated as having failed.

19. The method of claim 18, wherein step c) includes basing the incremental count of each lamp binary counter upon the 60 Hz ac power supply, using a zero crossing detector, thereby ensuring the reliability of the binary counter increments.

20. The method of claim 19, wherein said step f) includes the employment of a binary counter wherein said binary counter is incremented through a count equal to the number of interconnected lamps, the incremental count of said counter being based upon the 60 Hz ac power supply, using a zero crossing detector, and using said incremental count to identify each tone generated by the operative interconnected lamps in sequence, in order to determine which lamps are operative and which have failed.

21. The method of claim 18, wherein said plurality of lamps have a plurality of shorting devices associated in correspondence therewith, said method including the additional steps of:

g) incrementing each said binary counter through a number of counts equal to the number of interconnected lamps a second time;

h) generating a tone at each of said lamps at a predetermined frequency when the corresponding binary counter to each said lamp reaches a count equal to a numerical identifier for that particular lamp, if the corresponding shorting device for said particular lamp is operative;

i) transmitting each said tone over said power wires back to said processor; and j) processing each of the tones received from said lamps and activating a caution or failure alarm if a predetermined number of shorting devices are indicated as having failed.

* * * * *

UNITED STATES PATENT AND TRADEMARK OFFICE

CERTIFICATE OF CORRECTION

PATENT NO. : 5,397,963

DATED : March 14, 1995

INVENTOR(S) : James D. Manson

It is certified that error appears in the above-indentified patent and that said Letters Patent is hereby corrected as shown below:

Column 5, line 25; delete "of".

Column 5, line 36; delete "detection" and insert in place thereof --detecting--.

Column 14, line 61 and Column 16, line 12; delete "wires" and insert in place thereof --lines--.

Signed and Sealed this

Eighteenth Day of March, 1997

Bruce Lehman

*Attest:*

BRUCE LEHMAN

*Attesting Officer*

*Commissioner of Patents and Trademarks*